US008402773B2

(12) United States Patent
Broerman

(10) Patent No.: US 8,402,773 B2
(45) Date of Patent: Mar. 26, 2013

(54) TWO-STAGE COOLING SYSTEM

(75) Inventor: Steven E. Broerman, Cincinnati, OH (US)

(73) Assignee: Illinois Tool Works, Glenview, IL (US)

( * ) Notice: Subject to any disclaimer, the term of this patent is extended or adjusted under 35 U.S.C. 154(b) by 1042 days.

(21) Appl. No.: 12/407,759

(22) Filed: Mar. 19, 2009

(65) Prior Publication Data

US 2009/0235672 A1 Sep. 24, 2009

Related U.S. Application Data

(60) Provisional application No. 61/038,528, filed on Mar. 21, 2008.

(51) Int. Cl.
*F25B 9/02* (2006.01)
*F25D 23/12* (2006.01)

(52) U.S. Cl. ..... 62/5; 62/259.2

(58) Field of Classification Search ..... 62/5, 259.2; 181/270, 224, 256
See application file for complete search history.

(56) References Cited

U.S. PATENT DOCUMENTS 2,896,849 A * 7/1959 Argentieri et al. ..... 236/13
3,654,768 A * 4/1972 Inglis et al. ..... 62/5
4,019,986 A * 4/1977 Burris et al. ..... 210/139
5,010,736 A 4/1991 York et al.
5,335,854 A * 8/1994 Seitz et al. ..... 239/146
6,637,546 B1 * 10/2003 Wang ..... 181/264
6,868,938 B2 * 3/2005 Lecours ..... 181/231
6,990,817 B1 1/2006 Bhatia
7,461,513 B2 * 12/2008 Broerman et al. ..... 62/5
7,751,188 B1 * 7/2010 French et al. ..... 361/691
2007/0209370 A1 9/2007 Broerman et al.

OTHER PUBLICATIONS

Notification of Transmittal of the International Search Report and the Written Opinion of the International Searching Authority, dated Oct. 23, 2009.

* cited by examiner

*Primary Examiner* — Frantz Jules
*Assistant Examiner* — Cassey D Bauer
(74) *Attorney, Agent, or Firm* — Setter Roche LLP

(57) ABSTRACT

A two-stage cooling system configured to cool an interior of an enclosure includes a cabinet, a first vortex tube secured within the cabinet, and a second vortex tube secured within the cabinet. The cabinet defines a venting chamber. The first and second vortex tubes each include a hot pipe within the venting chamber and a cool gas delivery pipe extending outwardly from the cabinet. The first and second cool gas delivery pipes are configured to deliver cold gas to the interior of the enclosure. A separate thermostat may be operatively attached to each vortex tube and extend outwardly from the cabinet to be positioned within the interior of the enclosure. Additionally, first and second dampening sleeves may be secured around at least a portion of the first and second hot pipes, respectively, such that the dampening sleeves dampen noise produced by the vortex tubes.

17 Claims, 9 Drawing Sheets

TWO-STAGE COOLING SYSTEM

RELATED U.S. APPLICATION DATA

The present invention claims the benefit of the filing date under 35 U.S.C. §119(e) of U.S. Provisional Patent Application Ser. No. 61/038,528, filed on Mar. 21, 2008, which is hereby incorporated by reference in its entirety.

FIELD OF THE INVENTION

The present invention relates generally to a two-stage cooling system configured to cool the interior of an enclosure.

BACKGROUND OF THE INVENTION

Various enclosures, whether they are sealed, substantially sealed, or unsealed to their surrounding environment are cooled. Typically, the enclosures house various components that may be adversely affected by temperatures elevated above room or ambient temperature. In the case of enclosures containing electrical equipment, heat buildup within the enclosures can damage the components and/or cause safety hazards, for example, fires. Many of these enclosures, particularly those that are substantially or completely sealed, are not easily ventilated.

U.S. Pat. No. 3,654,768, entitled "Vortex Tube Cooling System" (the "'768 patent") which is hereby incorporated by reference in its entirety, discloses a cooling system particularly adapted for various types of enclosures, including sealed, substantially sealed, and unsealed enclosures. The system disclosed in the '768 patent is a vortex tube cooling system that includes a mechanical thermostat operable to actuate a valve that controls the flow of compressed air to the vortex tube, which, in turn, controls the temperature inside the enclosure. The embodiments described in the '768 patent provide a relatively small, thermostatically controlled cooling system that is easy to install and requires relatively low maintenance, when compared to conventional "Freon type" air conditioners. The systems disclosed in the '768 patent, however, provide a cooling system that produces high noise levels. In particular, the noise created by the high velocity spinning air within a vortex tube may be objectionable to some. Such noise may annoy, irritate, or even cause discomfort to, an operator of the enclosure, or those in close proximity to the enclosure.

Previous attempts at minimizing noises produced by the vortex tube include attaching mufflers to the hot and cold ends of the vortex tube. The mufflers, however, do not substantially reduce the noise levels a significant amount.

U.S. Pat. No. 7,461,513, entitled "Cooling System" (the "'513 patent") which is hereby incorporated by reference in its entirety, discloses a compact cooling system that is easy to install and produces low noise levels. The system disclosed in the '513 patent has a single cooling device, which results in a limited cooling capacity of the system.

U.S. Pat. No. 5,010,736, entitled "Cooling System for Enclosures" (the "'736 patent") discloses a two-stage enclosure cooler. The system disclosed in the '36 patent employs two different types of cooling. The first stage of cooling is a simple air-to-air heat exchange and the second stage is a vortex tube cooler. In the system described in the '736 patent, the first stage heat exchanger operates continuously, never shutting off. Because its first stage cooler is a heat exchanger (and not an 'active' cooling device), temperatures inside the enclosure used with the system may never be cooled below the ambient temperature conditions.

Thus, a need exists for a cooling system having a substantial cooling capacity that is also easy to install and produces low noise levels.

There is a further need or desire for a cooling system that allows for reduced compressed air consumption during periods of low heat load.

SUMMARY OF THE INVENTION

A two-stage cooling system in accordance with the principles of the invention provides cool air to enclosures, such as electrical enclosures. Certain embodiments of the present invention provide a cooling system configured to cool an interior of an enclosure that includes a cabinet defining a venting chamber, and a first vortex tube including a first hot pipe within the venting chamber, and a first cool gas delivery pipe extending outwardly from the cabinet, and a second vortex tube including a second hot pipe within the venting chamber, and a second cool gas delivery pipe extending outwardly from the cabinet. The first and second cool gas delivery pipes are configured to deliver cool gas (such as air) to the interior of the enclosure.

A first thermostat may be operatively attached to the first vortex tube and extend outwardly from the cabinet. Likewise, a second thermostat may be operatively attached to the second vortex tube and extend outwardly from the cabinet. The first and second thermostats may each be configured to be positioned within the interior of the enclosure. Because each of the vortex cooling devices inside the cabinet is controlled by a separate mechanical thermostat, they can be adjusted so that only one cooler operates when the heat load (temperature in the enclosure) is low; and then, if and when the heat load rises, the second vortex cooling device is activated. This allows for reduced compressed air consumption during periods of low heat load.

One or more porous plastic tubes may be connected to an outlet of the first hot pipe and an outlet of the second hot pipe. Exhaust gas from the first hot pipe and the second hot pipe may be routed to the one or more porous plastic tubes and pass through the porous plastic tube or tubes.

One or more one-way check valves may be operatively attached to the second hot pipe to prevent backflow of hot exhaust from the first hot pipe into the second hot pipe.

A dampening sleeve may be secured around at least a portion of each of the first and second hot pipes. The dampening sleeves may be formed of rubber and act to absorb, dampen, or otherwise reduce noise produced by the respective vortex tube.

The cabinet may include a base integrally formed with a rear wall and lateral walls. An upper wall may be integrally formed with the rear wall and the lateral walls, together defining the venting chamber. A cover may be placed over the venting chamber, and at least one dampening sheet may line at least a portion of the base, the rear wall, the lateral walls, and/or the upper wall. The dampening sheet is configured to dampen noise produced by the first and second vortex tubes. Additionally, flexible dampening rods may be disposed within the venting chamber to further dampen noise produced by the vortex tubes.

Certain embodiments of the invention also provide one or more vent pipes secured within the cabinet and configured to allow gas within the interior of the enclosure to vent into the venting chamber. One or more flexible open-ended tubes may be secured to the vent pipe or pips. The flexible open-ended tubes may be configured to allow gas to vent from the vent pipes through the flexible tubes.

Certain embodiments of the invention may also include a venting opening within the cabinet to allow gas to vent out of the cabinet. Additionally, a shroud may be secured to the cabinet over the venting opening. The shroud may include an exhaust path designed to allow exhaust gas that passes through the venting opening to pass through the exhaust path. In particular, the shroud may include one or more internal baffles configured to prevent liquid infiltration. Additionally, a baffle may be disposed within the cabinet in order to segregate the venting chamber into a hot exhaust portion and a cool exhaust portion.

One or more bleed air holes may be configured to be in fluid communication with the interior of the enclosure and a source of air. The bleed air hole is operable to allow air to pass into the enclosure to maintain a pressure differential between the interior of the enclosure and an outside environment. The pressure differential prevents debris from infiltrating into the enclosure even when the vortex tube is deactivated.

This invention will become more fully understood from the following detailed description, taken in conjunction with the accompanying drawings described herein below, and wherein like reference numerals refer to like parts.

DESCRIPTION OF PREFERRED EMBODIMENTS

Figure 1:
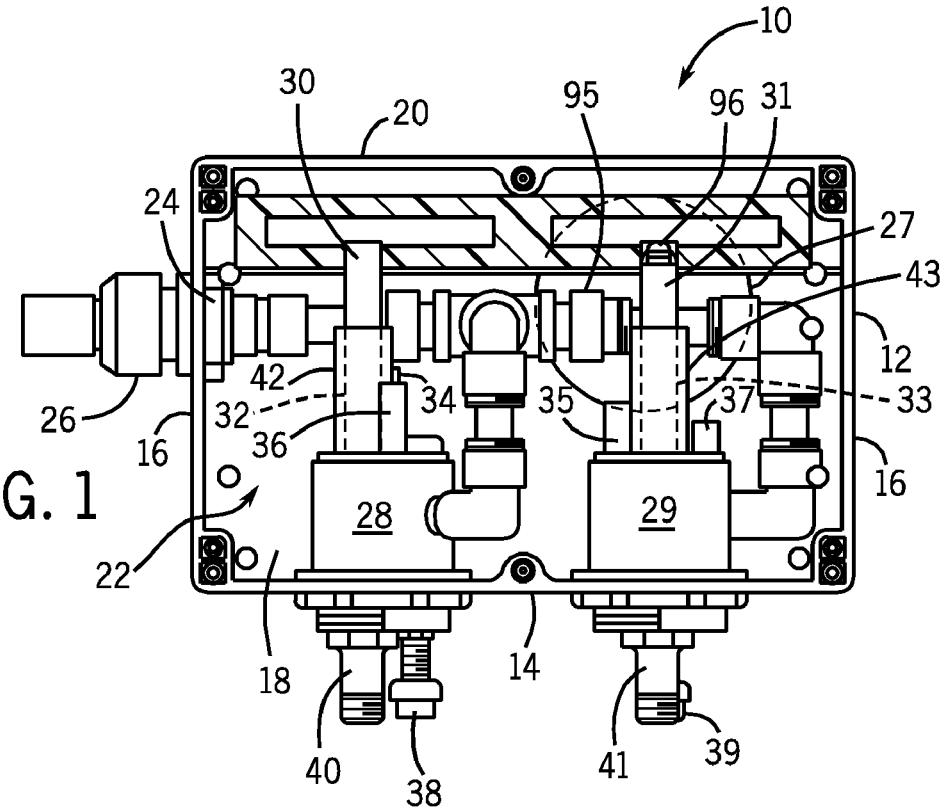
FIG. 1 illustrates a front perspective interior view of a two-stage cooling system according to an embodiment of the present invention.

FIG. 1 illustrates a front perspective interior view of a two-stage cooling system 10 according to an embodiment of the present invention. The cooling system 10 includes a cabinet 12, which may be formed of polycarbonate, that includes a base 14 integrally formed with lateral walls 16, and a rear wall 18. The lateral walls 16 and rear wall 18 are, in turn, integrally formed with an upper wall 20. The base 14, the lateral walls 16, the rear wall 18, and the upper wall 20 define a venting chamber 22 therebetween. A removable front cover (not shown in FIG. 1) is secured to edges of the base 14, lateral walls 16, and upper wall 20 to enclose the venting chamber 22.

A gas inlet passage 24 is formed through one of the lateral walls 16. The gas inlet passage 24 is configured to receive and retain a gas delivery tube, pipe, duct, or the like 26 of a gas (such as air) compression system (not shown in FIG. 1). The gas inlet passage 24 may securely retain the gas delivery pipe 26 through a threadable or compression type connection. The gas inlet passage 24 is connected to the first and second main heat conduction housings 28 and 29, described below.

A venting hole 27 is formed through the rear wall 18. The venting hole 27 allows gas, such as air, within the venting chamber 22 to pass out of the cooling system 10.

A first cylindrical main heat conduction housing 28 may be securely retained within a hole (not shown) formed in the base 14 through a variety of connections. For example, the first cylindrical main housing 28 may be threadably secured within the hole, or the first cylindrical main housing 28 may be bonded to the base 14. The first main heat conduction housing 28 extends into the venting chamber 22 and supports a first vortex tube 30 that includes a first hot tube, pipe, duct or the like 32, and first cool gas delivery pipe 40 extending through the base 14 of the cabinet 12. The first main heat conduction housing 28 also supports two upwardly extending vent tubes, pipes, ducts, or the like 34 and 36. A first thermostat 38 and the first cool gas delivery pipe 40 extend from the first main heat conduction housing 28 through the base 14. The first hot pipe 32 may be one end of the first vortex tube 30, while the first cool gas delivery pipe 40 may be the opposite end of the first vortex tube 30.

Similarly, a second cylindrical main heat conduction housing 29 may be securely retained within a hole (not shown) formed in the base 14 through a variety of connections. For example, the second cylindrical main housing 29 may be threadably secured within the hole, or the second cylindrical main housing 29 may be bonded to the base 14. The second main heat conduction housing 29 extends into the venting chamber 22 and supports a second vortex tube 31 that includes a second hot tube, pipe, duct or the like 33, and second cool gas delivery pipe 41 extending through the base 14 of the cabinet 12. The second main heat conduction housing 29 also supports two upwardly extending vent tubes, pipes, ducts, or the like 35 and 37. A second thermostat 39 and the second cool gas delivery pipe 41 extend from the second main heat conduction housing 29 through the base 14. The second hot pipe 33 may be one end of the second vortex tube 31, while the second cool gas delivery pipe 41 may be the opposite end of the second vortex tube 31.

The first cylindrical main heat conduction housing 28 is connected to the second cylindrical main heat conduction housing 29 with compressed air piping 95; the compressed air inlet piping 95 is in fluid communication with the gas inlet passage 24.

The first and second main heat conduction housings 28 and 29 are each operable to produce cool gas, such as air, that is delivered out of the cooling system 10 via the first and second cool gas delivery pipes 40 and 41, respectively. The first and second thermostats 38 and 39 are each configured to detect temperatures within an enclosure (not shown). The first and second main heat conduction housings 28 and 29 operate to produce cool air based on temperature readings of the respective first and second thermostats 38 and 39 that is delivered through the respective first and second cool gas delivery pipes 40 and 41.

Because each of the first and second main heat conduction housings 28 and 29 are controlled by separate first and second thermostats 38 and 39, the first and second main heat conduction housings 28 and 29 can be adjusted so that only the first main heat conduction housing 28 operates when the heat load, or temperature in the enclosure, is low. If or when the heat load rises, the second main heat conduction housing 29 is activated. Alternatively, the first and second main heat conduction housings 28 and 29 can be adjusted so that only the second main heat conduction housing 29 operates when the heat load is low, and the first main heat conduction housing 28 can be activated when the heat load rises. This two-stage cooling system 10 allows for reduced compressed air consumption during periods of low heat load. The following scenario is an example of how the two-stage cooling system 10 may operate:

Temperature in the enclosure rises—at 90 degrees Fahrenheit (F.), the first main heat conduction housing 28 turns on.

Temperature in the enclosure continues to rise—at 100 degrees F., the second main heat conduction housing 29 turns on.

Temperature in the enclosure begins to drop—at 90 degrees F., the second main heat conduction housing 29 turns off.

Temperature in the enclosure drops further—at 80 degrees F., the first main heat conduction housing 28 turns off.

The two-stage cooling system 10 is particularly well-suited for cooling electrical enclosures. Whereas a single-stage cooling system may be capable of producing up to 2500 BTUH of cooling, the two-stage cooling system 10, with two cooling devices inside the main heat conduction housings 28 and 29, has a much greater cooling capacity of 5000 BTUH, for example.

As a byproduct of this heat conduction process, however, the first (and potentially second) main heat conduction housings 28 (and 29) also produce heated gas, such as air, within the venting chamber 22. The heated gas is vented through the venting hole 27. Furthermore, because of the two-stage characteristics of the system 10, there is preferably at least one one-way check valve 96 at the hot end of the second, or second-stage, vortex tube 31. Without a one-way check valve 96, when only the first stage of cooling is activated, it is possible that hot exhaust from the first-stage cooler, or first vortex tube 30, may flow back through the hot exhaust of the second-stage cooler, or second vortex tube 31, and into the enclosure, thereby reducing or defeating the cooling effect of the first-stage cooler, or first vortex tube 30. The one-way check valve 96 at the hot end of the second-stage vortex tube 31 prevents such backflow.

Figure 2:
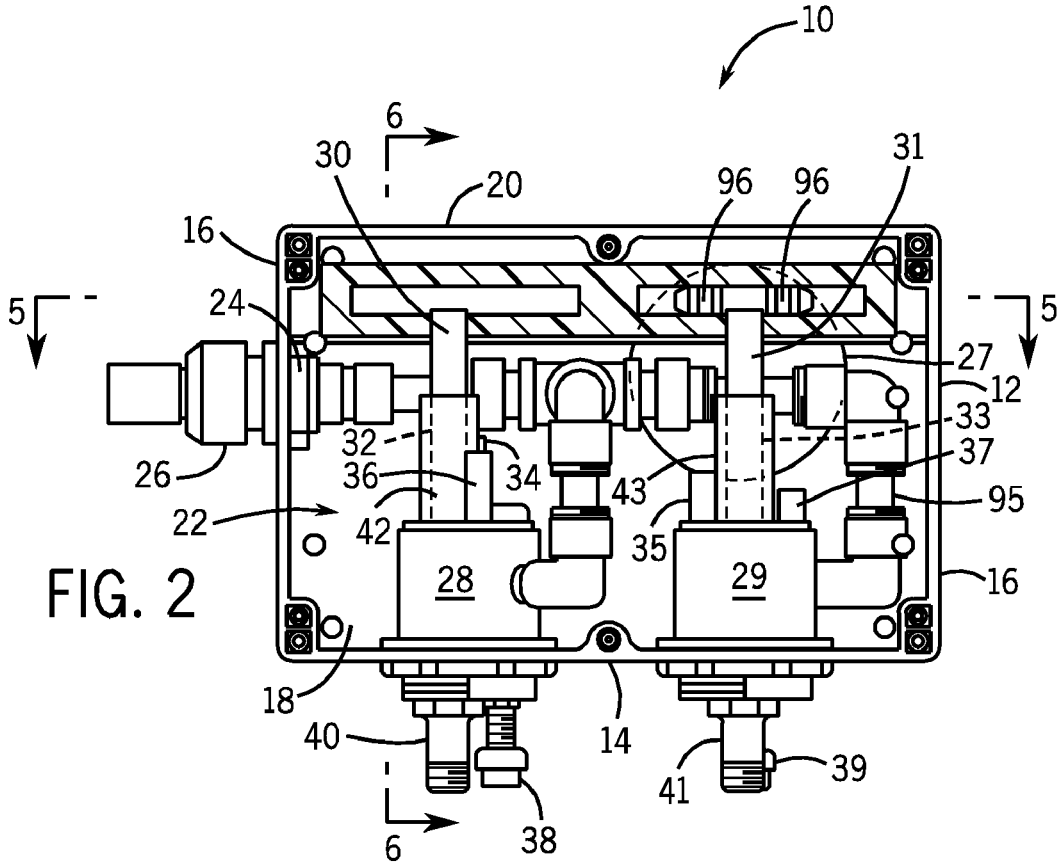
FIG. 2 illustrates a front perspective interior view of a two-stage cooling system according to another embodiment of the present invention.

FIG. 2 illustrates the two-stage cooling system 10 with two one-way check valves 96 at the hot end of the second-stage vortex tube 31.

Figure 3:
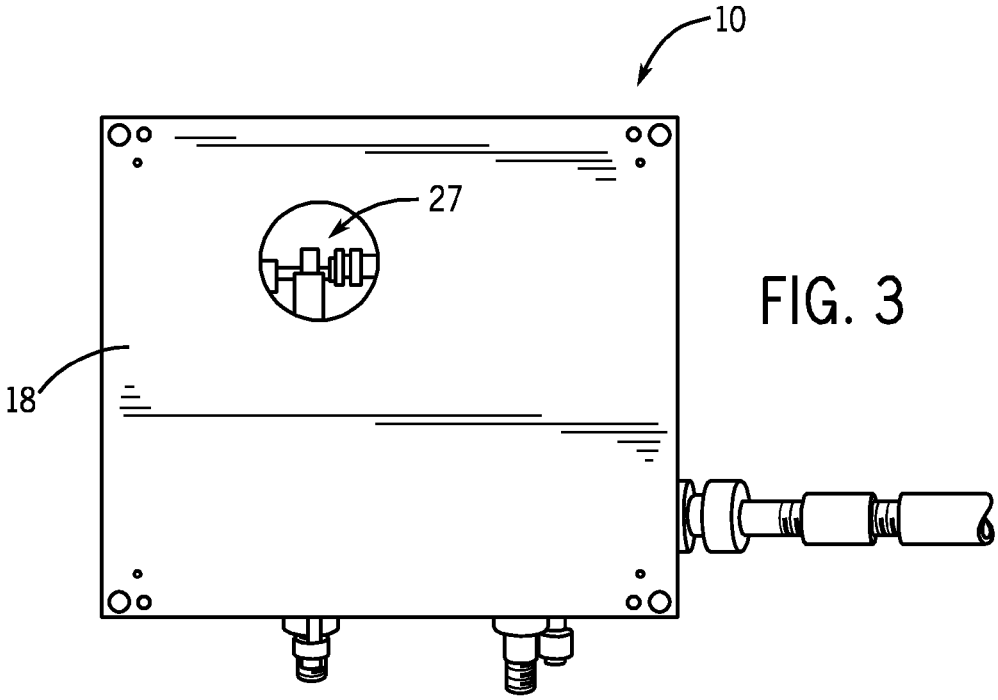
FIG. 3 illustrates a rear perspective view of a two-stage cooling system according to an embodiment of the present invention.

FIG. 3 illustrates a rear perspective view of the two-stage cooling system 10. As shown in FIG. 3, the venting hole 27 provides a passage for gas within the venting chamber 22 (shown in FIG. 1) to pass out of the cooling system 10.

Figure 4:
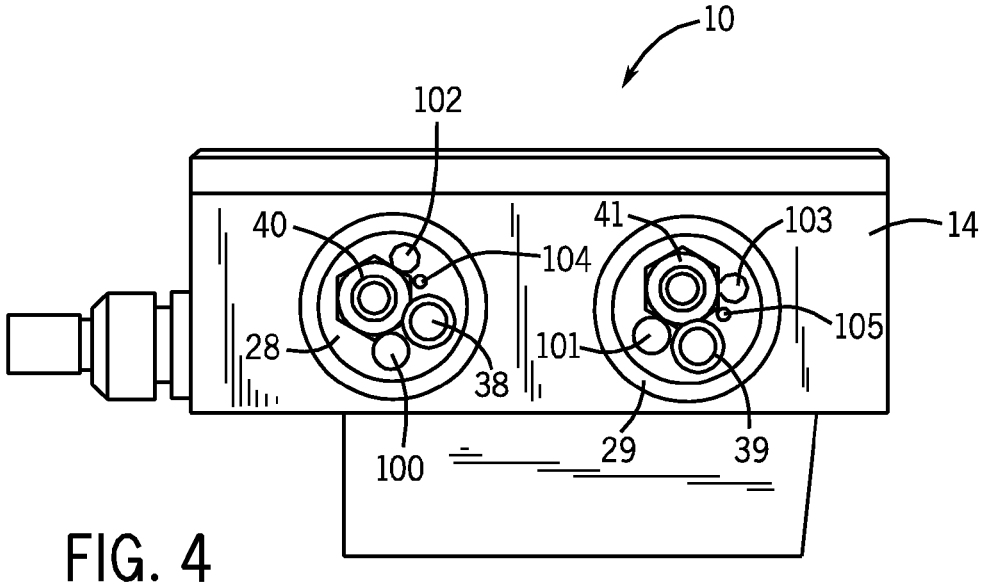
FIG. 4 illustrates a bottom perspective view of a two-stage cooling system according to an embodiment of the present invention.

FIG. 4 illustrates a bottom perspective view of the two-stage cooling system 10. As shown in FIG. 4, the first and second main heat conduction housings 28 and 29 are secured within the base 14. The first and second thermostats 38 and 39 and the first and second cool gas delivery pipes 40 and 41 of the respective first and second vortex tubes 30 and 31 extend downwardly from the main heat conduction housings 28 and 29. A vent hole 100 is formed through the first main heat conduction housing 28 and is in fluid communication with the vent pipe 34 (shown in FIG. 1). Likewise, a vent hole 101 is formed through the second main heat conduction housing 29 and is in fluid communication with the vent pipe 35 (shown in FIG. 1). Similarly, a vent hole 102 is also formed through the first main conduction housing 28 and is in fluid communication with the vent pipe 36 (shown in FIG. 1). Likewise, a vent hole 103 is also formed through the second main conduction housing 29 and is in fluid communication with the vent pipe 37 (shown in FIG. 1). The vent holes 100 and 102 allow gas, such as air, to pass into the vent pipes 34 and 36, into the hot area of the venting chamber 22 (shown in FIG. 1), and eventually out of the cooling system 10 via the venting hole 27 (shown in FIGS. 1 and 2). The vent holes 101 and 103 also allow gas, such as air, to pass into the vent pipes 35 and 37, into the hot area of the venting chamber 22, and eventually out of the cooling system 10 via the venting hole 27. A first bleed air hole 104 may also be formed through the first main heat conduction housing 28 and is configured to allow gas to pass from the first main heat conduction housing 28 out of the cooling system 10 into an enclosure. Similarly, a second bleed air hole 105 may also be formed through the second main heat conduction housing 29 and is configured to allow gas to pass from the second main heat conduction housing 29 out of the cooling system 10 into the enclosure. As discussed below, the bleed air holes 104 and 105 may be used to maintain a pressure differential between an interior of an enclosure and its outside environment to keep the enclosure interior clean.

Figure 5:
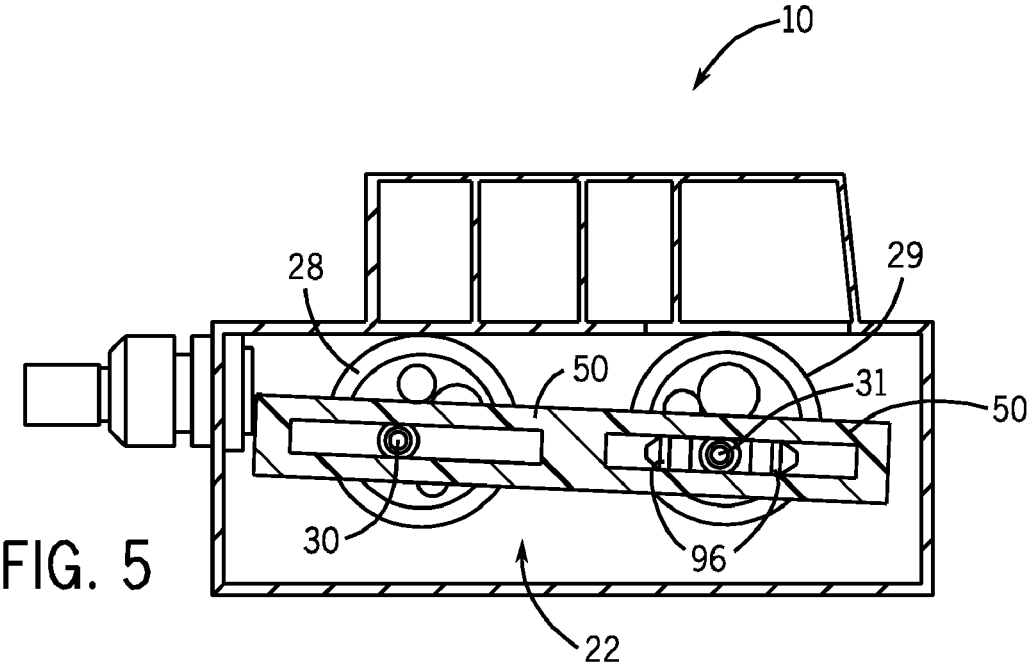
FIG. 5 illustrates a cross-sectional view of a two-stage cooling system taken along line 5-5 in FIG. 2, with the compressed air piping removed for clarity.

Various techniques may be used to reduce the noise level of the vortex tubes 30 and 31. For example, FIG. 5 illustrates a top perspective interior view of the two-stage cooling system 10 in which a porous plastic tube 50 is connected to an outlet of the hot end of the first vortex tube 30 and an outlet of the hot end of the second vortex tube 31. The porous plastic tube 50 may be secured within the venting chamber 22. The hot exhaust air expelled from each vortex tube 30 and 31 can be routed through a common porous plastic tube muffler 50 or the exhaust can be routed through separate mufflers 50. Because the tubing 50 is porous, hot exhaust gases may pass therethrough and out of the vent opening 27.

Figure 6:
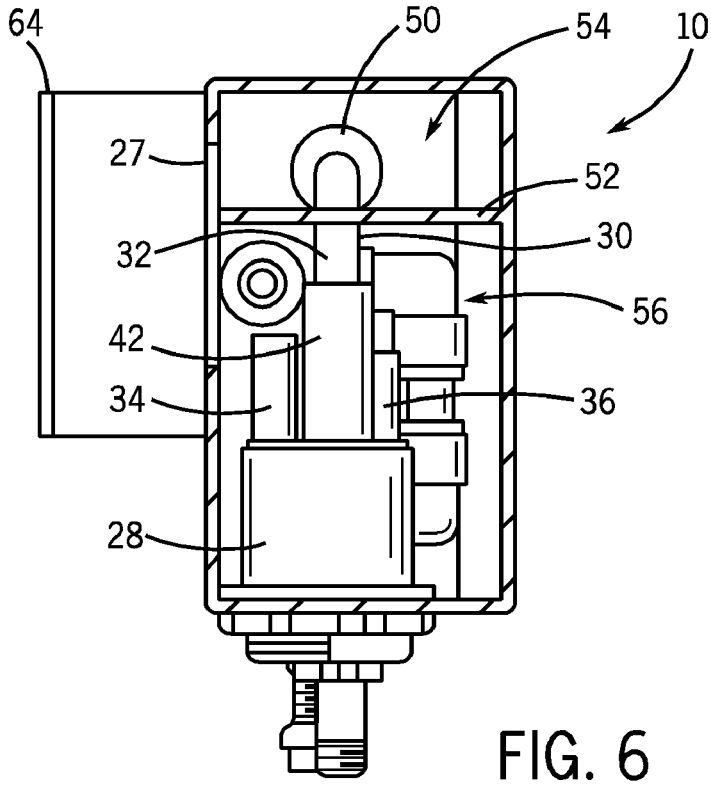
FIG. 6 illustrates a cross-sectional view of a two-stage cooling system taken along line 6-6 in FIG. 2.

FIG. 6 illustrates a side perspective interior view of the two-stage cooling system 10 in which a first dampening sleeve 42 is disposed over the first hot pipe 32. As shown in FIG. 1, a second dampening sleeve 43 is similarly disposed over the second hot pipe 33. The hot pipes 32 and 33 of the vortex tubes 30 and 31, respectively, are enclosed inside of the respective dampening sleeves 42 and 43, which may be an elastomeric or rubber hose that surrounds a substantial portion of the respective hot pipes 32 and 33. The dampening sleeves 42 and 43 may reduce noise produced within and/or by the vortex tubes 30 and 31 by dampening high frequency vibrations and resulting noise from the hot pipes 32 and 33. In any event, it has been found that disposing the dampening sleeves 42 and 43 around the hot pipes 32 and 33 dampens, or otherwise reduces, the amount of noise produced by the vortex tubes 30 and 31.

Figure 7:
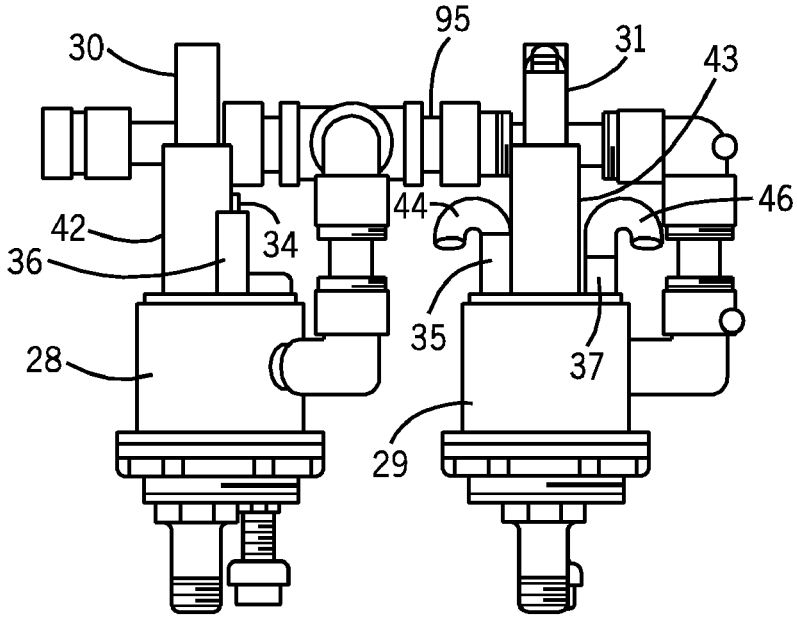
FIG. 7 illustrates a front perspective view of two vortex cooling devices connected through compressed air piping.

FIG. 7 illustrates a front perspective view of the two vortex cooling devices 30 and 31 connected through compressed air piping 95, with the remainder of the system removed for clarity. As shown in FIG. 7, a hollow, flexible, open-ended tube 44 is secured to the vent pipe 35, while a hollow, flexible, open-ended tube 46 is secured to the vent pipe 37. The tubes 44 and 46 may be vinyl tubes. Gas from the vent pipes 35 and 37 is passed into the tubes 44 and 46, respectively, and out into the cool area of the venting chamber 22 through the open ends of the tubes 44 and 46. In certain embodiments, similar hollow, flexible, open-ended tubes may be secured to the vent pipes 34 and/or 36.

Figure 8:
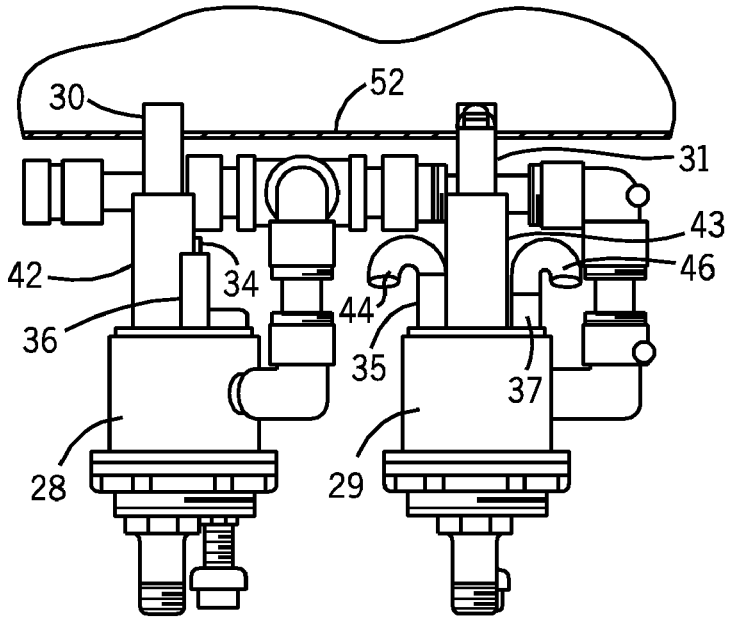
FIG. 8 illustrates the vortex cooling devices of FIG. 7 with a baffle at the top of the devices.
Figure 9:
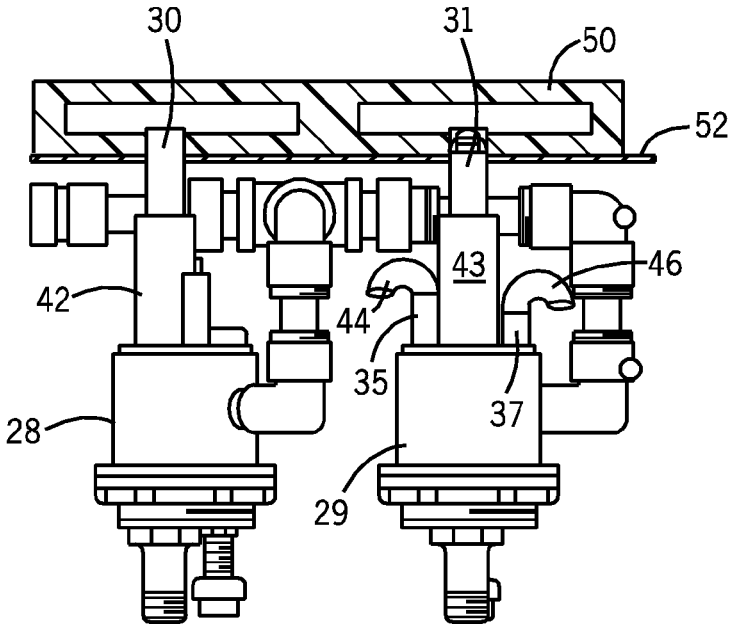
FIG. 9 illustrates the vortex cooling devices of FIG. 8 with a hot exhaust muffler attached to the devices.

A baffle 52 may be disposed within the cabinet 12 to segregate the venting chamber 22 into a hot exhaust portion and a cool exhaust portion. FIG. 8 illustrates a suitable positioning of the baffle 52 with respect to the two vortex cooling devices 30 and 31. FIG. 9 illustrates a suitable arrangement of the baffle 52 between the porous plastic tube muffler 50 and the two vortex cooling devices 30 and 31. As further illustrated in FIG. 6, this arrangement allows the venting hole 27 to be divided into a hot exhaust portion and a cool exhaust portion. Hot exhaust gas from the hot pipes 32 and 33 that passes out of the porous plastic tube muffler 50 vents out of the cooling system 10 through the hot exhaust portion of the venting hole 27, while cool exhaust gases from the vent pipes 34, 35, 36, and 37 vent out of the cooling system 10 through the cool exhaust portion of the venting hole 27. The baffle 52 may be plastic, rubber, vinyl, or the like, and serves to segregate the venting chamber 22 into two separate areas—-a hot exhaust area 54 and a cool air exhaust area 56. As such, hot and cool gases within the venting chamber 22 are separated from one another. The baffle 52 ensures that hot and cool air flows within the venting chamber 22 are separate from one another so that the pressure created by the hot exhaust gas does not overpower the vented cool air.

Figure 10:
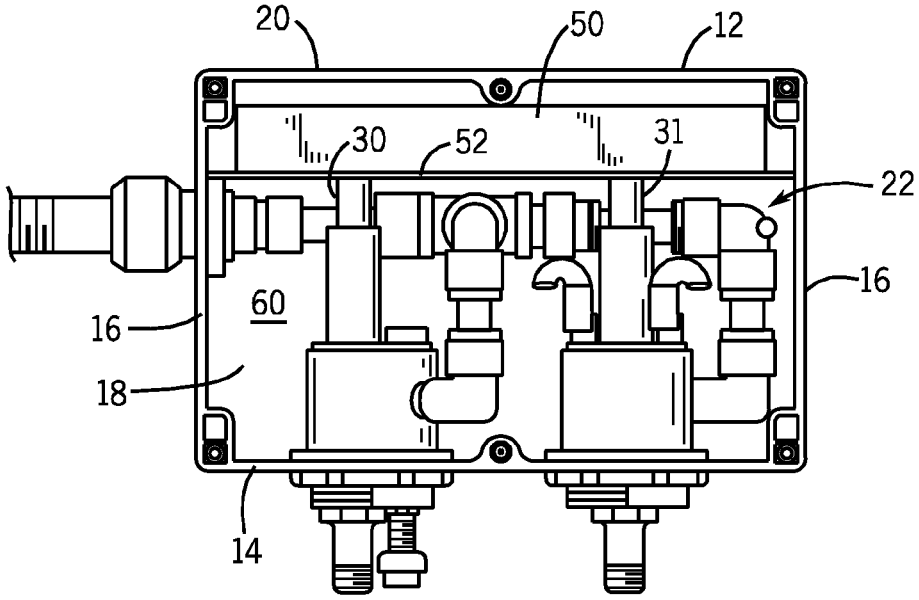
FIG. 10 illustrates the vortex cooling devices of FIG. 9 installed in a cabinet.

FIG. 10 illustrates the two vortex cooling devices 30 and 31 in place inside the cabinet 12. An open cell foam sheet 60 lines the rear wall 18 of the cabinet 12 within the venting chamber 22. Additionally, open cell foam may also line the base 14, lateral walls 16, and upper wall 20 of the cabinet 12 within the venting chamber 22. Further, sheets of open cell foam may also line an interior surface of a cover (not shown) of the cabinet 12. The open cell foam sheet 60, and any other cell foam within the venting cabinet 22, further dampens noise produced by the cooling system 10, while also allowing exhaust gas to flow through. Optionally, open cell foam sheets may line outer surfaces of the cabinet 12 in addition to, or in lieu of, interior surfaces of the cabinet 12 within the venting chamber 22. Alternatively, instead of open cell foam, the sheet 60 may be another dampening material, such as rubber, plastic, or the like.

Figure 11:
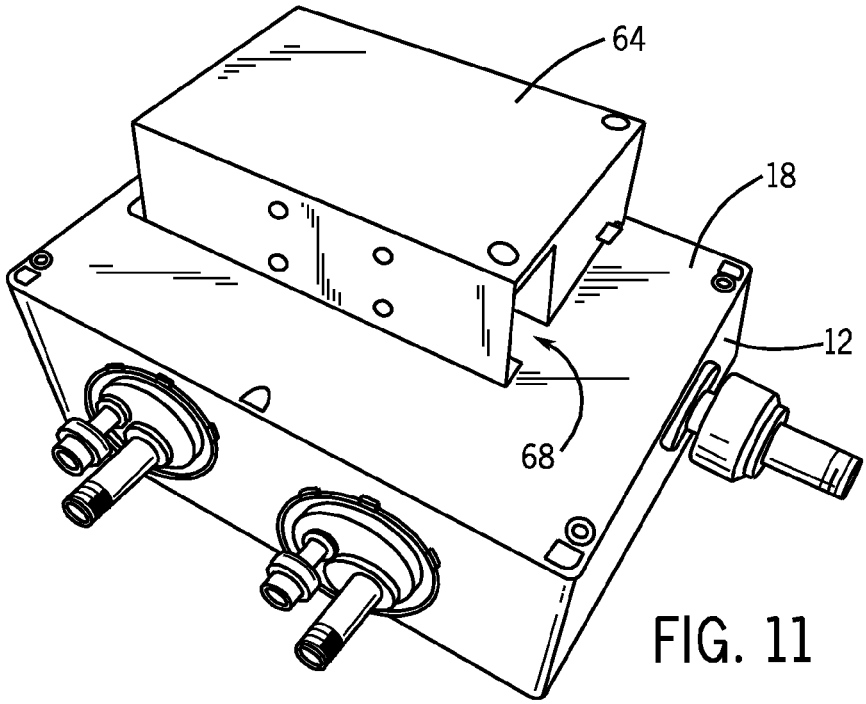
FIG. 11 illustrates a rear perspective view of a two-stage cooling system including a shroud over a rear venting wall according to an embodiment of the present invention.

As shown in FIG. 11, a shroud 64 is mounted over the outside of the rear wall 18 and may cover a substantial portion of the rear wall 18. An exhaust path is defined between an interior of the shroud 64 and an outer surface of the rear wall 18. As such, exhaust gases may pass out of the venting chamber 22 through the venting hole 27. The exhaust gases are then directed by the shroud 64 through an exhaust outlet 68 at the bottom of the shroud 64. For example, relatively cooler exhaust gases that pass from the vent pipes 35 and 37 out through the flexible tubes 44 and 46, respectively, may pass through the venting hole 27 and out of the cooling system 10 through the exhaust outlet 68. Similarly, hot exhaust gas that passes from the hot pipes 32 and 33 through the porous plastic tubing 50 (shown in FIG. 6) may pass through the pores of the plastic tubing 50, and out of the cooling system 10 through the venting hole 27. The hot exhaust gas may then pass out of the cooling system 10 through the exhaust outlet 68.

Figure 12:
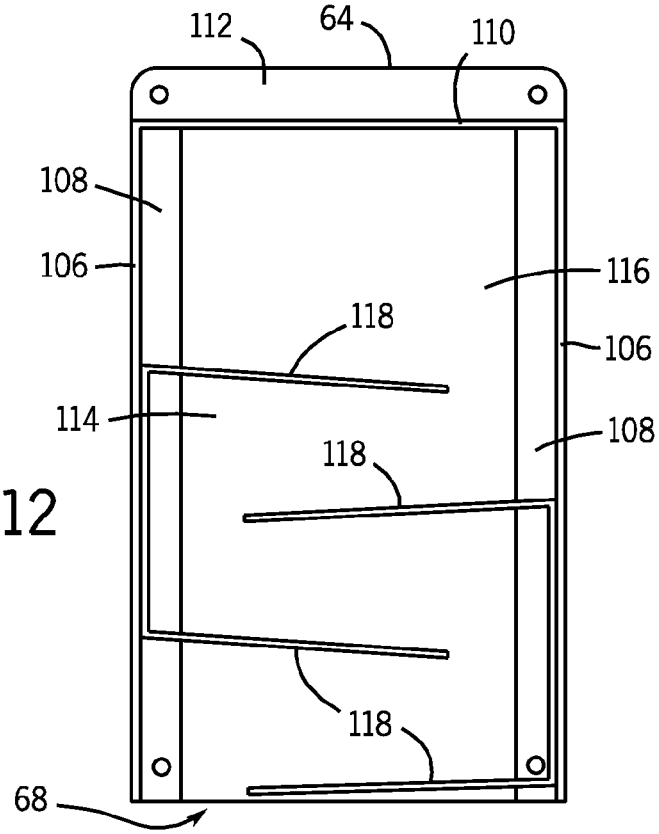
FIG. 12 illustrates an internal view of a shroud according to an embodiment of the present invention.

FIG. 12 illustrates an internal view of the shroud 64. The shroud 64 includes lateral walls 106 having mounting flanges or edges 108, a top wall 110, having a mounting flange or edge 112, and a cover 114. The lateral walls 106, the top wall 110, and the cover 114 define an exhaust chamber 116. The shroud 64 is configured to mount to the rear of the cabinet 12 (shown, for example, in FIGS. 6 and 11). For example, the shroud 64 is mounted so that mounting flanges 108 and 112 abut the rear wall of the cabinet 12.

A series of baffles 118 are positioned within the exhaust chamber 116. An exhaust outlet 68 is formed through the lower portion of the shroud 64, proximate a lower baffle 118. The baffles 118 are configured to prevent moisture from infiltrating the shroud 64. While four baffles 118 are shown, more or less baffles than those shown may be used with the shroud 64.

Figure 13:
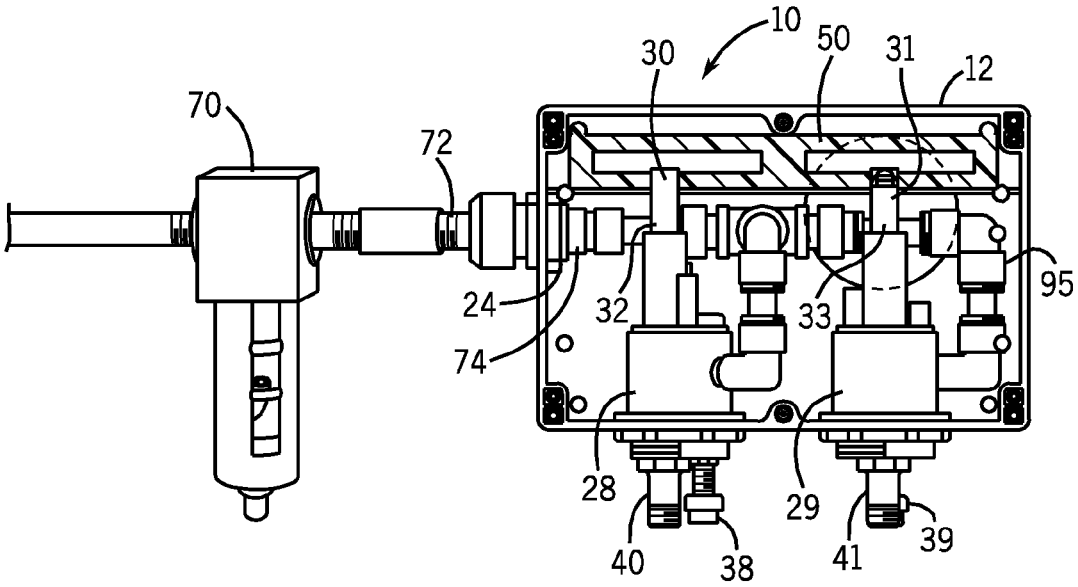
FIG. 13 illustrates a front perspective view of a two-stage cooling system connected to a compressed air filter according to an embodiment of the present invention.

FIG. 13 illustrates a front perspective view of the two-stage cooling system 10 connected to a compressed gas filter 70. The compressed gas filter 70 filters compressed gas, such as air, to the main heat conduction housings 28 and 29 through a delivery pipe 72. In an alternative arrangement, delivery pipe 72 is sealingly secured to a corresponding inlet pipe 74 that connects to the main heat conduction housings 28 and 29. The delivery pipe 72 and the inlet pipe 74 may be sealingly secured to one another, through, for example, a sealed threadable interface, proximate the gas inlet passage 24. Thus, compressed gas, such as air, may pass from the gas filter 70, through the delivery pipe 72 and into the inlet pipe 74, which, in turn provides a fluid path through the compressed air piping 95 and into the main heat conduction housings 28 and 29. The compressed gas passes into the vortex tubes 30 and/or 31, when the thermostats 38 and/or 39 call for cooling, including the hot pipes 32 and 33 and the cool gas delivery pipes 40 and 41, thereby producing cool gas that is passed through the cool gas delivery pipes 40 and 41. As such, the two-stage cooling system 10 may produce cooled gas through compressed air being supplied to the vortex tube or vortex tubes.

As shown in FIG. 13, the inlet pipe 74, which delivers compressed air into the cooling system 10, is within the cool exhaust portion of the cabinet 12 to ensure that the hot exhaust air from the pipe 50 is not in close proximity to the compressed air being delivered to the cooling system 10 through the inlet pipe 74.

Figure 14:
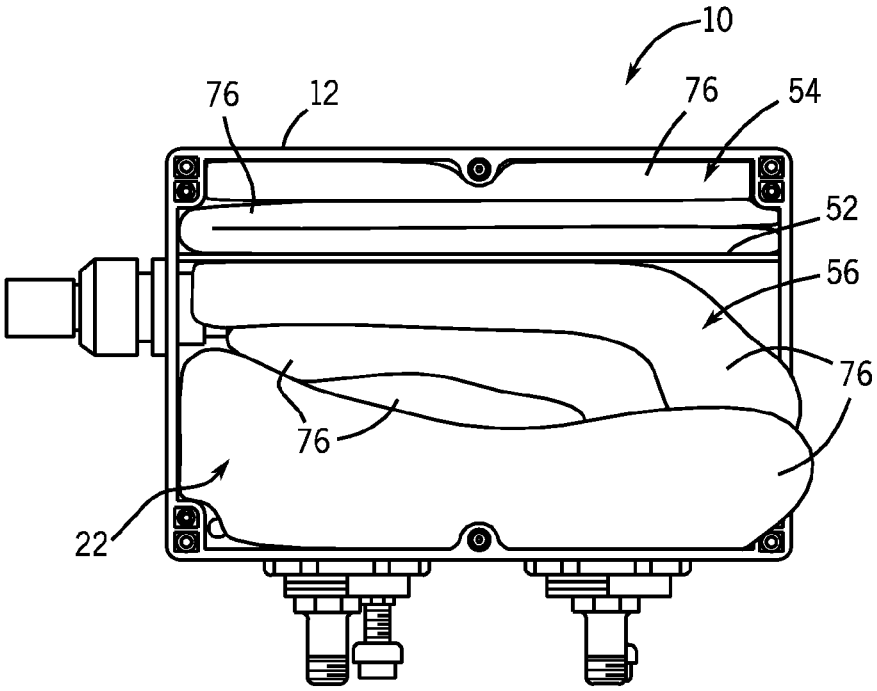
FIG. 14 illustrates a front perspective interior view of a two-stage cooling system with flexible dampening members according to an embodiment of the present invention.

FIG. 14 illustrates a front perspective interior view of the cooling system with a plurality of flexible dampening members 76. The flexible dampening members 76 may be flexible open cell foam rods. Each rod may have a diameter of approximately two inches. As shown in FIG. 14, two flexible dampening members 76 are folded and compressed into the hot exhaust area 54 of the venting chamber 22, while more dampening members 76 are folded and compressed into the cool air area 56. Additional dampening members 76 may be positioned within the venting chamber 22. Overall, the open cell foam, whether in the form of flexible rod-like dampening members 76, or sheets (such as open cell foam sheet 60 shown in FIG. 10) may occupy a substantial portion of the venting chamber 22. For example, open cell foam may occupy approximately 90% of the space within the venting chamber 22. The dampening members 76 provide additional noise damping within the cooling system 10, while at the same time, allowing exhaust gas to flow therethrough. Alternatively, the dampening members 76 may be formed of porous rubber, plastic, or the like.

Figure 15:
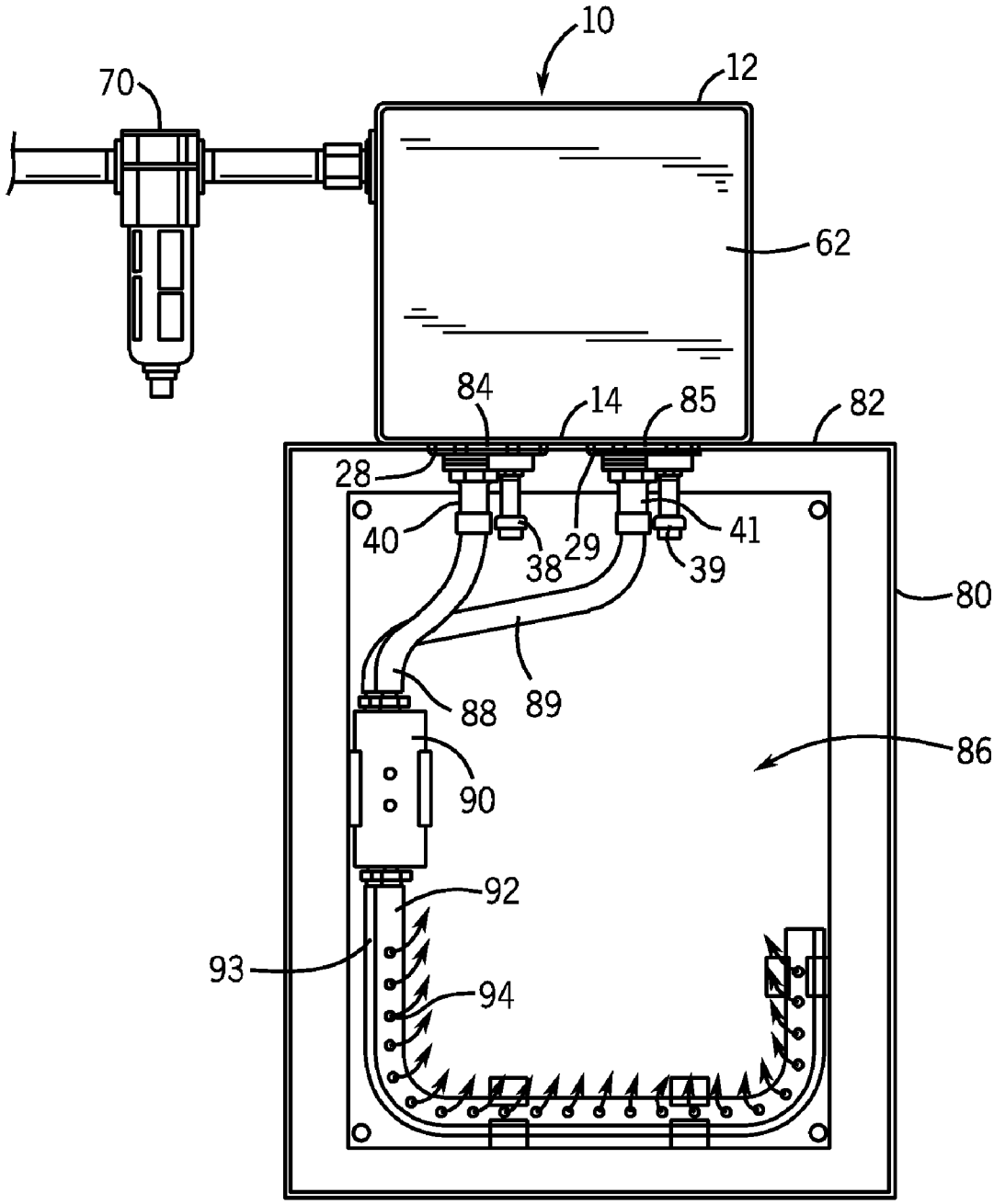
FIG. 15 illustrates a front elevational view of a two-stage cooling system connected to an enclosure according to an embodiment of the present invention.
Figure 16:
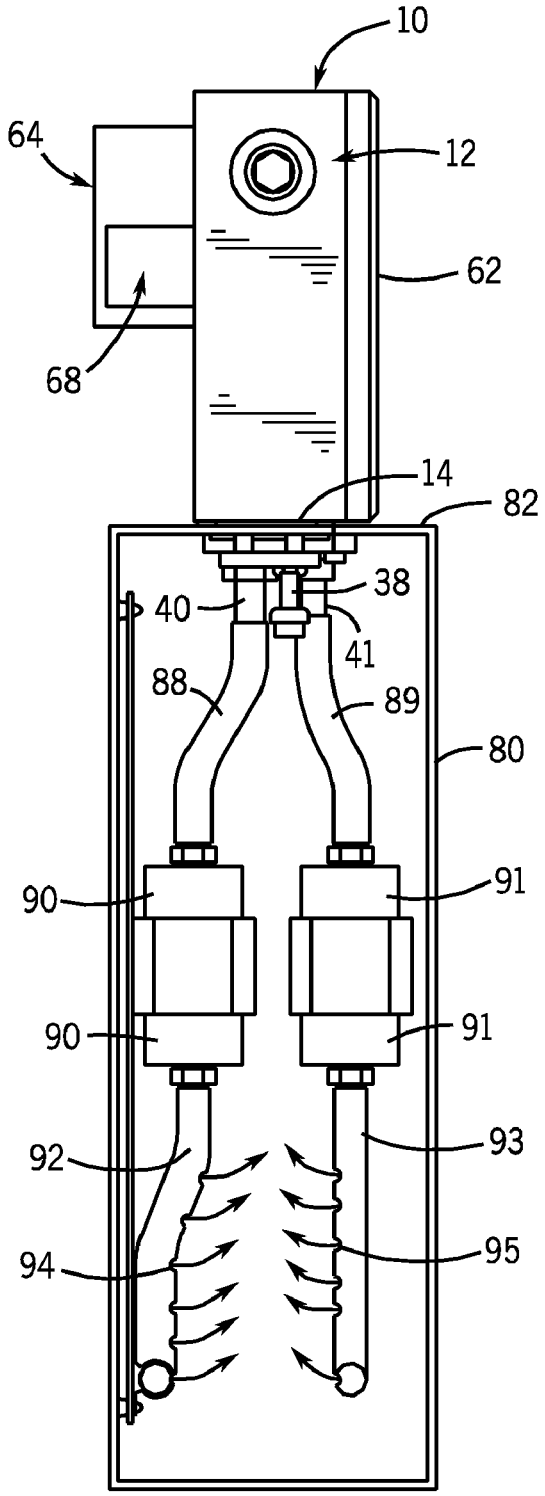
FIG. 16 illustrates a lateral elevational view of a two-stage cooling system connected to an enclosure according to an embodiment of the present invention.

FIGS. 15 and 16 illustrate a front elevational view and a lateral elevational view, respectively, of the two-stage cooling system 10 connected to an enclosure 80. The cabinet 12 mounts to the top of the enclosure 80 such that the base 14 is supported by a top surface 82 of the enclosure 80. Two knockout holes 84 and 85 are formed through the top surface 82 of the enclosure 80, and a lower portion of each of the main heat conduction housings 28 and 29 is sealingly secured within the respective knockout hole 84 and 85. The thermostats 38 and 39 and the cool gas delivery pipes 40 and 41 extend into an interior chamber 86 of the enclosure 80. The vent holes 100, 101, 102, and 103 (shown in FIG. 4), and the bleed air holes 104 and 105 (shown in FIG. 4) are also exposed to the interior chamber 86.

Gas, such as air, is supplied to the main heat conduction housings 28 and 29 through the compressed gas system and the air filter 70. The main heat conduction housings 28 and 29 then produce cool gas through the vortex tubes (which include the hot pipes and the cool gas delivery pipes). A distal end of each of the cool gas delivery pipes 40 and 41 is connected to one end of a flexible tube 88 and 89 which provides a fluid path from the cool gas delivery pipe 40 and 41 to a muffler 90 and 91, respectively. Sealed tubes 92 and 93 (which may also be a vinyl tube) having a plurality of passages 94 and 95 are connected to an opposite end of the respective muffler 90 and 91. Thus, cool gas may be delivered to the sealed tubes 92 and 93 through the path defined from the cool gas delivery pipes 40 and 41, the flexible tubes 88 and 89, and the mufflers 90 and 91. The cool gas then passes into the interior chamber 86 of the enclosure 80 to cool internal components. The gas may then be vented back into the cooling system 10 through the vent holes 100, 101, 102, and 103 (shown in FIG. 4), and out of the cooling system 10, as described above. As the interior chamber 86 of the enclosure 80 is being cooled, exhaust and vented gases pass out of the cooling system 10 through the exhaust outlet 68 located at a lower end of the shroud 64. Optionally, the sealed tubes 92 and 93 may be open-ended tubes without passages formed therethrough. In this case, the cold gas may pass through the open end of each tube.

Also shown in FIGS. 15 and 16, a cover 62 is secured over a front of the cabinet 12.

Referring to FIGS. 1, 2, 5-10, and 13-16, the dampening sleeves 42 and 43 positioned around the hot pipes 32 and 33, the porous plastic tube 50, the dampening sheets 60, dampening members 76 and cold air mufflers 90 and 91 all serve to dampen, diminish, absorb, or otherwise reduce noise created by the operation of the vortex tubes 30 and 31 (including the hot pipes 32 and 33). Thus, the two-stage cooling system 10 produces less noise than many prior vortex tube cooling devices.

Referring to FIGS. 4 and 16, the two-stage cooling system 10 is also capable of continually pressurizing and purging the enclosure 80, even when the vortex tubes 30 and 31 are deactivated. One benefit that the compressed air driven vortex tube cooling system 10 has over conventional "Freon type" air conditioners is that the cooling system 10 blows the cooling air into the enclosure 80 under a slight positive pressure. Thus, the pressure within the enclosure 80 is slightly higher than the air pressure outside of the enclosure 80. The pressure differential between the outside of the enclosure 80 and the interior of the enclosure 80 serves to ensure that contaminants do not infiltrate into the enclosure 80. In order to maintain this constant pressure differential (to keep the enclosure 80 clean), a source of compressed air (such as that supplied through the compressed gas filter 70) is connected to the bleed air holes 104 and 105 formed through the bottoms of the main heat conduction housings 28 and 29. Thus, the bleed air holes 104 and 105 are in fluid communication with the compressed gas supply port. The ends of the bleed air holes 104 and 105 may each threadably retain a removable set screw to plug the hole if pressurization of the enclosure 80 is not desired. As such, there is no need to drill an additional hole in the enclosure 80 to provide a path for a source of pressurized air that maintains a pressure differential between the interior chamber 86 of the enclosure 80 and the outside of the enclosure 80 (in order to keep the interior of enclosure 80 clean). Instead, the bleed air holes 104 and 105 may be in fluid communication with a compressed air supply, thereby allowing air to be continually blown into the enclosure 80, without operation of the main heat conduction housings 28 and 29. Thus, the enclosure 80 may remain clean even when the vortex tubes 30 and 31 are not operating.

Thus, embodiments of the present invention provide a compact cooling system that is easy to install, has substantial cooling capacity, and produces low noise levels. Embodiments of the present invention provide a cooling system that allows for reduced compressed air consumption during periods of low heat load. Additionally, embodiments of the present invention provide a vortex tube cooling system that may maintain a clean enclosure interior through air pressure differentials even when the cooling system is not operating in a cooling mode.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or the drawings. All of these different combinations constitute various alternative aspects of the present invention. The embodiments described herein explain the best modes known for practicing the invention and will enable others skilled in the art to utilize the invention.

What is claimed is:

1. A two-stage cooling system configured to cool an interior of an enclosure, comprising:

a cabinet defining a venting chamber;

a first vortex tube comprising (i) a first hot pipe within the venting chamber, and (ii) a first cool gas delivery pipe extending outwardly from the cabinet, the first cool gas delivery pipe configured to deliver cold gas to the interior of the enclosure; and a second vortex tube comprising (i) a second hot pipe within the venting chamber, (ii) a second cool gas delivery pipe extending outwardly from the cabinet, the second cool gas delivery pipe configured to deliver cold gas to the interior of the enclosure, and (iii) at least one one-way check valve operatively attached to the second hot pipe to prevent backflow of hot exhaust from the first hot pipe into the second hot pipe; and at least one porous plastic tube connected to an outlet of the first hot pipe and an outlet of the second hot pipe, wherein exhaust gas from the first hot pipe and the second hot pipe is routed to the at least one porous plastic tube and passes through the at least one porous plastic tube.

2. The two-stage cooling system of claim 1, further comprising a first thermostat operatively attached to the first vortex tube and extending outwardly from the cabinet, and a second thermostat operatively attached to the second vortex tube and extending outwardly from the cabinet, the first and second thermostats each configured to be positioned within the interior of the enclosure.

3. The two-stage cooling system of claim 1, further comprising two one-way check valves each operatively attached to the second hot pipe to prevent backflow of hot exhaust into the second hot pipe.

4. The two-stage cooling system of claim 1, further comprising:

a first dampening sleeve secured around at least a portion of the first hot pipe, the first dampening sleeve configured to dampen noise produced by the first vortex tube; and a second dampening sleeve secured around at least a portion of the second hot pipe, the second dampening sleeve configured to dampen noise produced by the second vortex tube.

5. The two-stage cooling system of claim 1, wherein the cabinet comprises:

a base integrally formed with a rear wall and lateral walls;

an upper wall integrally formed with the rear wall and the lateral walls, the venting chamber being defined by the base, the rear wall, the lateral walls, and the upper wall;

a cover over the venting chamber;

at least one dampening sheet lining at least a portion of at least one of the base, the rear wall, the lateral walls, and the upper wall, the at least one dampening sheet being configured to dampen noise produced by the first and second vortex tubes.

6. The two-stage cooling system of claim 5, further comprising at least one flexible dampening rod folded and compressed within the venting chamber.

7. The two-stage cooling system of claim 1, further comprising at least one vent pipe secured within the cabinet, wherein the at least one vent pipe is configured to allow gas within the interior of the enclosure to vent into the venting chamber.

8. The two-stage cooling system of claim 7, further comprising at least one flexible open-ended tube secured to the at least one vent pipe, wherein the at least one flexible open-ended tube is configured to allow gas to vent from the at least one vent pipe through the at least one flexible tube.

9. The two-stage cooling system of claim 1, wherein the cabinet further comprises a venting opening configured to allow gas to vent out of the cabinet.

10. The two-stage cooling system of claim 9, further comprising a shroud secured to the cabinet over the venting opening, the shroud comprising an exhaust path, wherein exhaust gas passing through the venting opening passes through the exhaust path.

11. The two-stage cooling system of claim 10, wherein the shroud comprises at least one internal baffle configured to prevent liquid infiltration.

12. The two-stage cooling system of claim 1, further comprising a baffle disposed within the cabinet, the baffle segregating the venting chamber into a hot exhaust portion and a cool exhaust portion.

13. The two-stage cooling system of claim 1, further comprising at least one bleed air hole configured to be in fluid communication with the interior of the enclosure and a source of air, the at least one bleed air hole operable to allow air to pass into the enclosure to maintain a pressure differential between the interior of the enclosure and an outside environment, wherein the pressure differential prevents debris from infiltrating the enclosure.

14. A two-stage cooling system configured to cool an interior of an enclosure, comprising:

a cabinet defining a venting chamber;

a first vortex tube comprising (i) a first hot pipe within the venting chamber, and (ii) a first cool gas delivery pipe extending outwardly from the cabinet, the first cool gas delivery pipe configured to deliver cold gas to the interior of the enclosure;

a second vortex tube comprising (i) a second hot pipe within the venting chamber, (ii) a second cool gas delivery pipe extending outwardly from the cabinet, the second cool gas delivery pipe configured to deliver cold gas to the interior of the enclosure, and (iii) at least one one-way check valve operatively attached to the second hot pipe to prevent backflow of hot exhaust from the first hot pipe into the second hot pipe;

a first dampening sleeve secured around at least a portion of the first hot pipe, the first dampening sleeve configured to dampen noise produced by the first vortex tube; and a second dampening sleeve secured around at least a portion of the second hot pipe, the second dampening sleeve configured to dampen noise produced by the second vortex tube.

15. The two-stage cooling system of claim 14, further comprising a first thermostat operatively attached to the first vortex tube and extending outwardly from the cabinet, and a second thermostat operatively attached to the second vortex tube and extending outwardly from the cabinet, the first and second thermostats each configured to be positioned within the interior of the enclosure.

16. The two-stage cooling system of claim 14, further comprising at least one porous plastic tube connected to an outlet of the first hot pipe and an outlet of the second hot pipe, wherein exhaust gas from the first hot pipe and the second hot pipe is routed to the at least one porous plastic tube and passes through the at least one porous plastic tube.

17. A two-stage cooling system configured to cool an interior of an enclosure, comprising:

a cabinet defining a venting chamber;

a first vortex tube comprising (i) a first hot pipe within the venting chamber, and (ii) a first cool gas delivery pipe extending outwardly from the cabinet, the first cool gas delivery pipe configured to deliver cold gas to the interior of the enclosure;

a second vortex tube comprising (i) a second hot pipe within the venting chamber, and (ii) a second cool gas delivery pipe extending outwardly from the cabinet, the second cool gas delivery pipe configured to deliver cold gas to the interior of the enclosure;

a first thermostat operatively attached to the first vortex tube and extending outwardly from the cabinet, and a second thermostat operatively attached to the second vortex tube and extending outwardly from the cabinet, the first and second thermostats each configured to be positioned within the interior of the enclosure at least one one-way check valve operatively attached to the second hot pipe to prevent backflow of hot exhaust from the first hot pipe into the second hot pipe; and at least one porous plastic tube connected to an outlet of the first hot pipe and an outlet of the second hot pipe, wherein exhaust gas from the first hot pipe and the second hot pipe is routed to the at least one porous plastic tube and passes through the at least one porous plastic tube.

* * * * *